United States Patent [19]

Miller

[11] Patent Number: 5,018,637

[45] Date of Patent: May 28, 1991

[54] BAG SUPPORT

[76] Inventor: Don Miller, 500 SW. 64 Ave., Miami, Fla. 33144

[21] Appl. No.: 474,986

[22] Filed: Feb. 6, 1990

[51] Int. Cl.[5] ..... B65D 90/04

[52] U.S. Cl. ..... 220/404; 220/94 A; 220/457; 220/908; 229/907; 229/117.14; 229/199; 248/152

[58] Field of Search ..... 220/404, 402, 403, 1 T, 220/94 R, 94 A, 86 R, 440, 454, 455, 457, 908; 248/95, 97, 99, 127, 152; 229/907, 117.14, 117.16, 199

[56] References Cited

U.S. PATENT DOCUMENTS

| | | | |
|---|---|---|---|
| 4,366,916 | 1/1983 | Guido et al. | 220/404 |
| 4,437,634 | 3/1984 | Hambleton | 248/97 |
| 4,534,489 | 8/1985 | Bartlett | 220/404 |
| 4,576,310 | 3/1986 | Isgar et al. | 220/404 |
| 4,664,347 | 5/1987 | Brown et al. | 248/97 |
| 4,669,689 | 6/1987 | Jones | 248/99 |
| 4,695,020 | 9/1987 | Collins | 248/100 |
| 4,697,771 | 10/1987 | Majors | 248/97 |
| 4,711,367 | 12/1987 | Albertson | 220/404 |
| 4,867,339 | 9/1989 | Hahn | 220/404 |
| 4,907,710 | 3/1990 | Bulkens | 220/1 T |

FOREIGN PATENT DOCUMENTS

| | | | |
|---|---|---|---|
| 0506076 | 6/1957 | Italy | 229/199 |

*Primary Examiner*—Stephen Marcus
*Assistant Examiner*—Stephen K. Cronin
*Attorney, Agent, or Firm*—Krass & Young

[57] ABSTRACT

The present invention relates to a collapsible trash container that holds a plastic grocery bag in an open position inside the container so that the plastic bag may be loaded with trash. The container is substantially rectangular having a base, four sidewalls terminating in an open top, and two detachable handle elements having inverted U-shaped slots. A pair of bag-engaging tab members protrude vertically from the free edges of a pair of opposing sidewalls. The handles of a plastic bag are arrayed about these tabs to hold the bag in an open position. The preferred embodiment of the present invention further includes a hingably mounted cover that may be opened when the container is being loaded and closed when the container is not being loaded.

10 Claims, 3 Drawing Sheets

FIG - 1
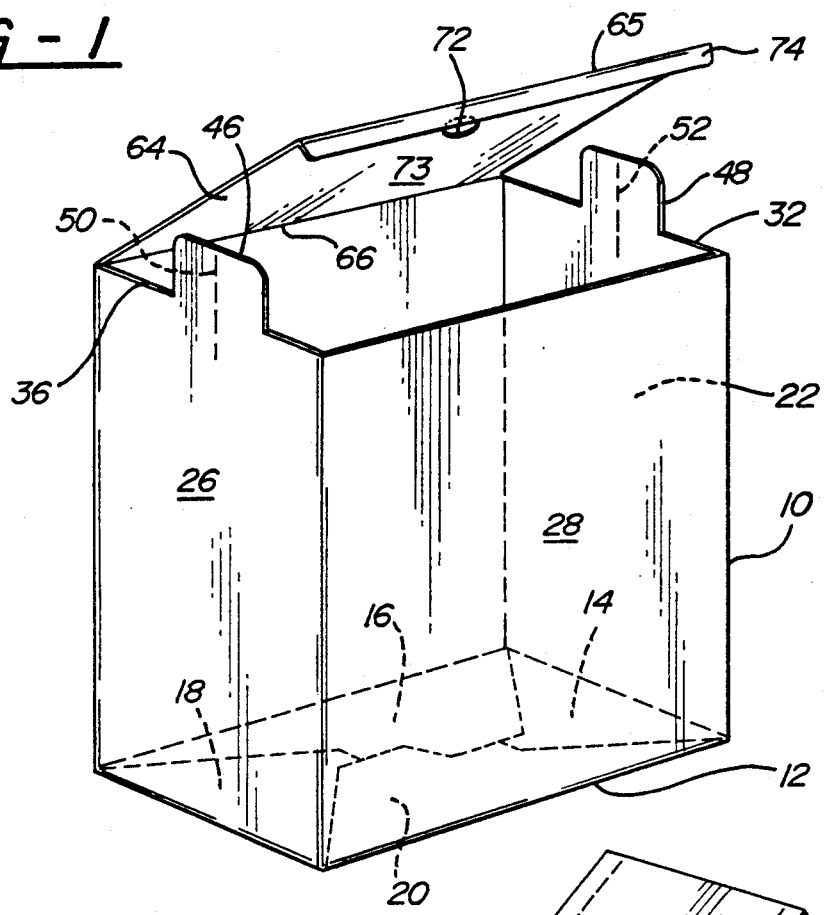
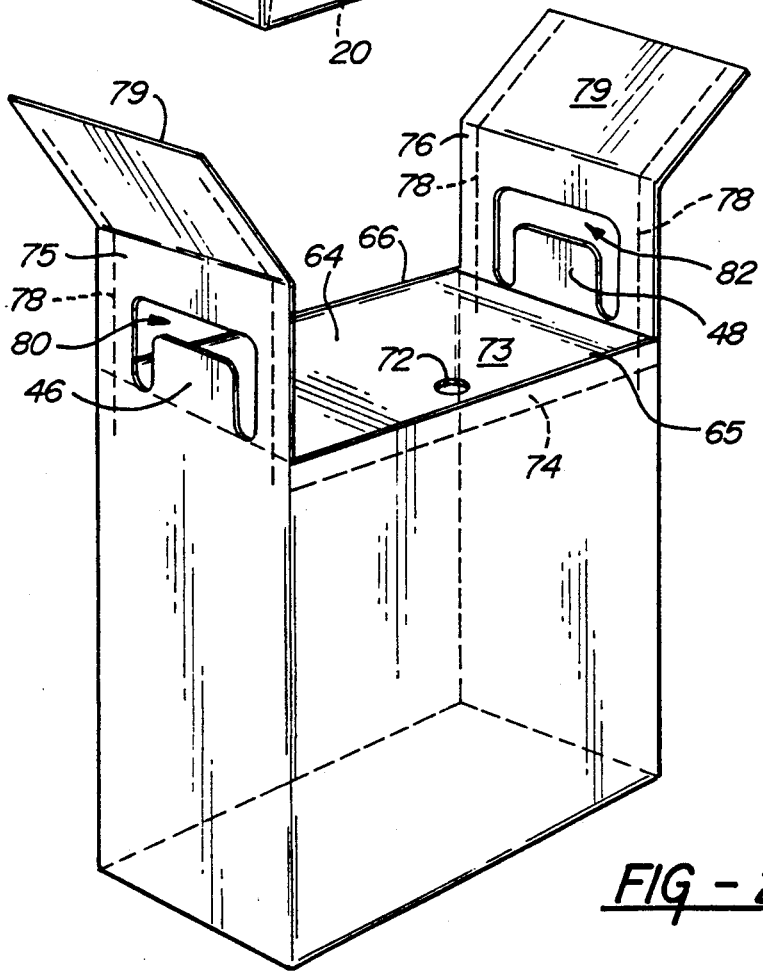
FIG - 2

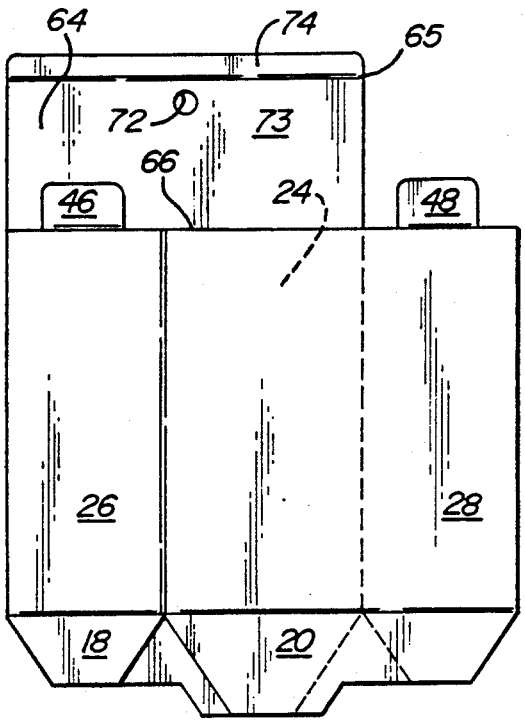
FIG - 5A
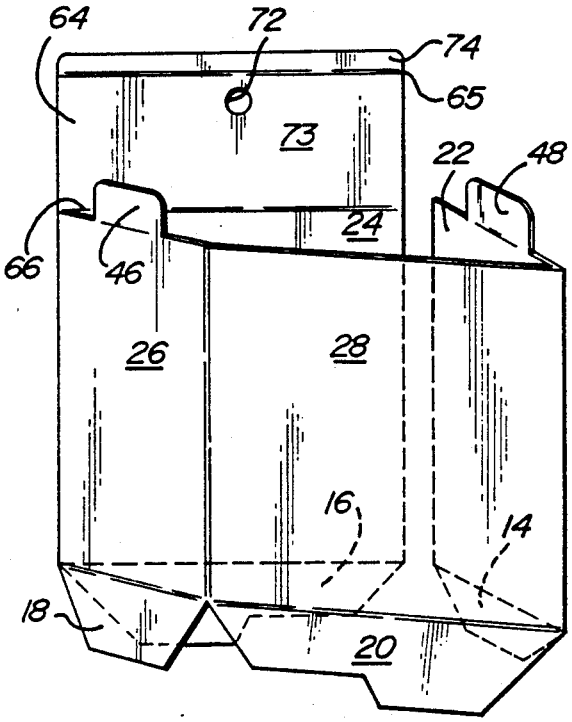
FIG - 5B
FIG - 6
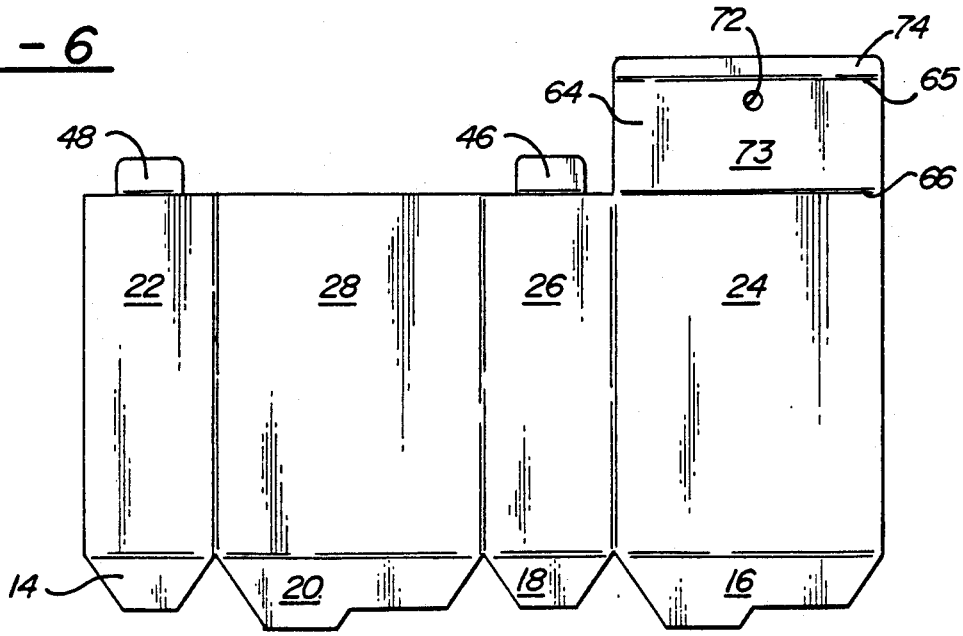

BAG SUPPORT

BACKGROUND OF THE INVENTION

1. Field of the Invention

The present invention relates generally to a collapsible trash container for use with film plastic grocery bags, and more particularly, to a container adapted to support plastic grocery bags in an open position so that they may receive trash.

2. Description of the Related Art

An increasing number of commercial stores are using plastic grocery bags at the check-out counter to package goods that consumers purchase. These bags are generally formed of flexible sheet plastic and have two handles to facilitate carrying. The handles have the appearance of a T-shirt, hence they are called, and will be referred to hereinafter as, "T-shirt bags."

Before the widespread use of T-shirt bags, many stores used paper bags at the check-out counter. Consumers often re-used these paper bags, inside rigid containers, to receive trash. Paper bags function well as liners for trash containers since they are self-supporting and remain upright when placed in a trash container.

T-shirt bags cannot be re-used as easily for this purpose since they lack rigidity. They do not remain in an open position in the trash container without some type of support.

In response to this problem several types of devices have been proposed. One type is disclosed in U.S. Pat. Nos. 4,763,808, 4,735,340 and 4,535,911. These patents disclose attachments or brackets adapted to be affixed to the edges of an otherwise conventional trash container to hold a T-shirt bag in an open position.

A second type of container for plastic bags is disclosed in U.S. Pat. Nos. 4,664,347 and 4,576,310. These patents disclose rigid plastic containers having bag-engaging members integral with their bodies to hold a T-shirt bag in an open position.

Collapsible containers have also been proposed, although not with respect to trash containers. U.S. Pat. Nos. 3,459,357 and 3,550,833 disclose collapsible boxes that are adhesively lined with inner plastic bags. These boxes are primarily used for shipping liquids and viscous, powdered or granular substances.

SUMMARY OF THE INVENTION

There is a need for a portable, collapsible trash container that compacts for easy mobility and stands upright to support a T-shirt bag in an open position for receiving trash therein. The present invention fulfills this need.

A preferred embodiment of the present invention comprises a substantially rectangular trash container that is formed from a single sheet of corrugated cardboard. The cardboard sheet has fold lines so as to be folded from a collapsed, substantially planar position into an upright container.

The body of the container includes a planar base member integrally joined with four side walls that extend vertically from the base member terminating in an open top. The base member is comprised of four leaves, each leaf being joined along one edge with a corresponding side wall along a fold line. The leaves are adhesively joined together along their inner edges to form the planar base member.

A pair of detachable rectangular panels having inverted U-shaped slots extend upwardly from the top free edges of a pair of opposing side walls, thus simultaneously forming a pair of tabs and a pair of handle elements. FIG. 1 illustrates the preferred embodiment of the present invention with the panels detached while FIG. 2 illustrates the preferred embodiment of the present invention with the panels in the attached position. Each tab member has a single wire inserted vertically through its corrugated central portion to give the tab member added rigidity. A T-shirt bag's handles are placed about the tab members so that the bag is held in an open position to receive trash. If the panels are not detached, the handle elements may be used to move the container from place to place, or, in the alternative, the panels may be removed and the tabs may be grasped to the container.

The preferred embodiment of the present invention further includes a movable covers hinged to the rear wall of the container. This cover may be opened when the container is being loaded or closed when the container is not being loaded.

Additionally, the present invention is disposable. This makes the invention quite convenient for camping trips, picnics, outings, etc.

The corrugated board may be treated with a water-resistant coating so as to prevent the contents of the container from leaking through to the outside of the container. The corrugated board also makes the trash container lightweight, yet durable.

These and other advantages of the present invention will be apparent from the following description and drawings of a preferred embodiment of the invention.

BRIEF DESCRIPTION OF THE DRAWINGS

FIG. 1 is a perspective view of the preferred embodiment of the present invention in an open position with the panels detached;

FIG. 2 is a perspective view of the preferred embodiment of the present invention in a closed position with the panels attached;

FIG. 5A is a perspective view of the preferred embodiment of the present invention in a collapsed position; FIG. 5B is a perspective view of the invention in a partially collapsed state; and FIG. 6 is a developed view of the preferred embodiment of the present invention.

DETAILED DESCRIPTION OF THE PREFERRED EMBODIMENT

Figure 3:
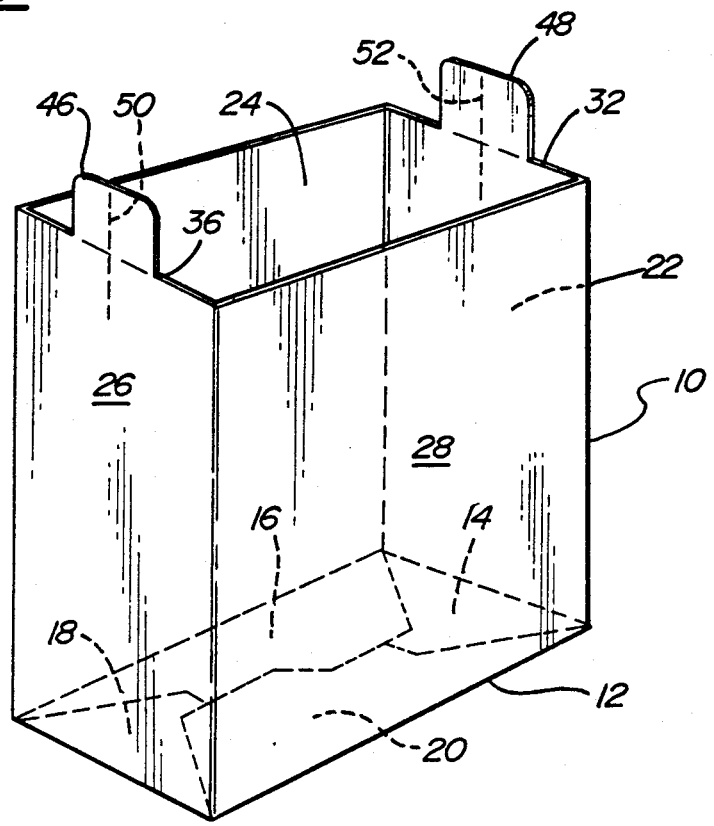
FIG. 3 is a perspective view of a second embodiment of the present invention.

The present invention comprises a substantially rectangular trash container formed from a single sheet of corrugated cardboard. As shown in FIG. 2, the container further includes two panels having inverted U-shaped slots 80, 82 to be used as handles and two tabs 46,48 for engaging the handles of a T-shirt bag so that the bag is supported in an open position within the container to receive trash.

The container is provided in a first, collapsed, generally planar form, as indicated in FIG. 5A, and is expandable to a self-supporting rectangular trash container. In the collapsed form the container encloses substantially no interior space and is referred to as being in a generally planar configuration, it being understood that such configuration may include one or more overlapping layers while still being regarded as "planar."

In the expanded, substantially rectangular configuration, the container is self-supporting so as to at least partially enclose an interior volume such that a T-shirt bag may be supported therein.

Referring now to the FIG. 1, the preferred embodiment of the present invention comprises a substantially rectangular trash container 10 formed from a single sheet of corrugated cardboard. The cardboard may be coated with a material so as to be moisture-resistant.

The container comprises a planar base member 12 integrally joined to four side walls 22, 24, 26, 28 along fold lines such that the side walls extend vertically from the base member 12 terminating in an open top. The base member is formed from four leaves, 14, 16, 18, 20, that are adhesively joined along their edges. One edge of each leaf is integrally joined to a corresponding side wall along a fold line. Specifically, leaf 14 is integrally joined with side wall 22; leaf 16 is integrally joined with side wall 24; leaf 18 is integrally joined with side wall 26; and leaf 20 is integrally joined with side wall 28.

A pair of rectangular tab members 46,48 are disposed on the free edges of opposite side walls. These tab members 46,48 extend away from the planar base 12. Tab member 46 is integrally associated with free edge 36 of side wall 26, and tab member 48 is integrally associated with the opposed free edge 32 of side wall 22.

Figure 4:
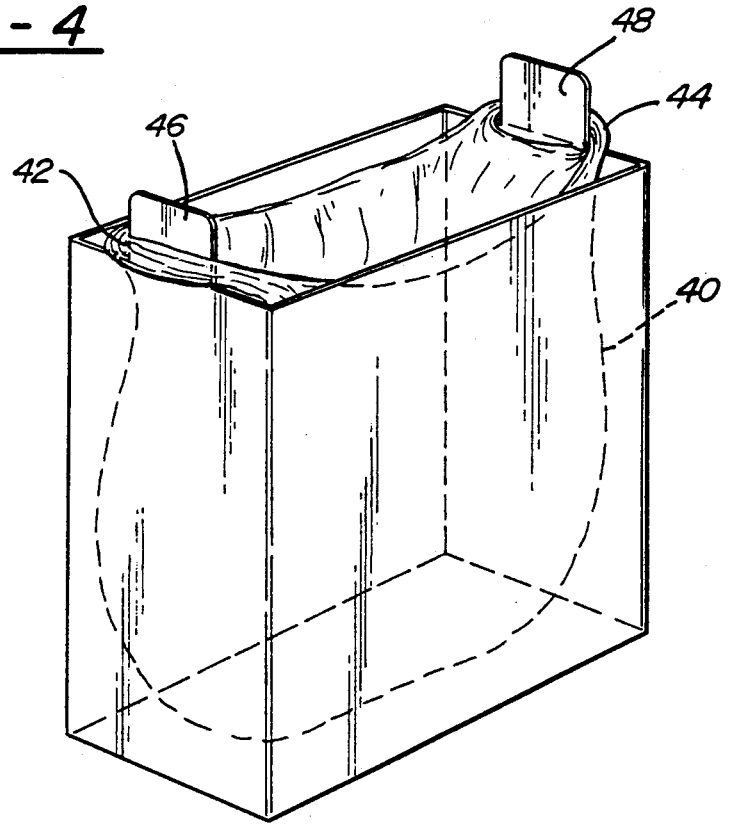
FIG. 4 is a perspective view of an embodiment of the present invention showing a T-shirt bag arrayed over the bag-engaging tab members.

As shown in FIG. 4, tab members 46,48 engage the handles of a T-shirt bag so as to support the T-shirt bag in an open position to receive trash.

The tab members 46,48 each retain their rigidity by means of single wire inserts 50,52 that extend through the corrugated central portion of tab members 46,48. Wire insert member 50 extends the entire vertical length of tab member 46, terminating within the upper portion of side wall 26. Similarly, wire insert member 52 extends the entire vertical length of tab member 48, terminating within the upper portion of side wall 22.

The preferred embodiment of the invention further includes a rigid cover 64 hingably attached along a crease line 66 to the back side wall 24 of the container 10. The rigid cover 64 comprises a planar rectangular portion 73 that is formed integrally with an inner flap 74 along a second crease line 65. The cover 64 may be pivoted about the axis of the crease line 66 between a first open position when the container 10 is being loaded, as shown in FIG. 1, and a second closed position when the container 10 is not being loaded, as shown in FIG. 2.

The cover 64 is pivoted about the axis of the crease line 66 by means of an aperture 72. In the preferred embodiment, the aperture 72 is centered on the front edge of the planar rectangular portion of the cover 64.

The present invention may also be constructed without a cover, as shown in FIG. 3.

Additionally, the preferred embodiment includes detachable handle elements 75 and 76 integrally disposed on the free edges of opposite side walls. The handles are located on the same side walls as tab members 46,48 as shown in FIG. 2. Handles 75,76 retain their rigidity by means of wire inserts 78, essentially twice as long as inserts 50,52, which extend through the corrugated handles 75,76 and terminate within the upper portion of its respective side wall.

Handle elements 75,76 and tab members 46,48 may also retain rigidity through the use of a double wall of corrugated cardboard, as opposed to a single corrugated sheet. This may eliminate the need for wire inserts, while retaining rigidity. This embodiment also allows handle elements 75, 76 to be easily bent outward along the top edge of the side wall so that the handle elements 75, 76 do not interfere with closing the cover 64 as it is swung downward, or with the operative use of tab members 46, 48.

Further, deflector panels 79, extending above handle elements 75, 76 either angled or coplanar with the handle elements 75, 76, can additionally be utilized to provide a deflecting surface, used in conjunction with the raised cover 64, to assist in placing trash in the suspended t-shirt bag. Wire inserts 78 may be extended into these deflector panels 79 to retain the panels 79 positioned for proper deflection. These panels 79 are typically produced from excess cardboard material during the manufacturing process from a single sheet of cardboard and may be removed at the top of handle elements 75, 76 if not desired.

Preferably, the outside surfaces of the trash container would be decorated with aesthetically pleasing colors or patterns Also, the inside surface may be treated for water resistance in a manner well known in the industry.

Having thus described my invention, it can be seen that numerous alternative configurations can be envisioned without departing from the spirit of this invention.

I therefore claim:

1. A container adapted to support a bag formed of flexible sheet material, the bag having a body formed with a base, side walls integral with the base, an open top, and a pair of generally inverted U-shaped bag handles having legs formed integrally with the side walls of the bag and extending from opposed sides of the free edges of the side walls, said container comprising:

A) a rigid rectangular planar base;

B) four rigid sheet side walls integrally formed with the base and extending upward from the periphery of the base generally normal to the base and terminating in a free edge lying in a plane generally parallel to the base;

C) a pair of handle elements integrally formed on the free edges of two opposing side walls and extending away from the base and beyond said free edge of the side walls, the handle elements each having an inverted U-shaped slot exposing a pair of tabs integrally formed within said handle elements, said tabs being adapted to fit within said handles of said bag, each said tab having the free edge of the side wall as a base;

whereby, the opposed handles of a bag may be arrayed over said tabs so that the bag is draped within and supported by the interior side walls of the container in an open attitude.

2. A container as in claim 1, wherein the container is formed from corrugated board.

3. A container as in claim 1, wherein the container is coated with a moisture-resistant material.

4. A container as in claim 1, wherein each tab is made rigid by a single wire extending vertically through the center portion of each said tab.

5. A container as in claim 1, wherein said planar base is formed from four interlocking leaves, each of said leaves having one side integrally attached with a lower edge of one of said side wall.

6. The container as in claim 5, wherein said four interlocking leaves are adhesively joined.

7. A container as in claim 1, wherein the container has a cover, said cover having one edge integrally formed with and hingably attached to a free edge of a side wall, said hingable attachment forming a crease line extending the entire width between said cover and said side wall such that said cover may be pivoted about the crease line between a first open position and a second closed position.

8. A container as in claim 7, wherein said cover comprises a planar rectangular portion integrally formed with an inner flap along a crease line that extends the entire width between the rectangular portion and the inner flap of the cover.

9. A container as in claim 8, wherein said planar rectangular portion of said cover includes an aperture whereby said aperture is operative in opening and closing said cover.

10. A container as in claim 1, wherein said one of said container further includes a pair of deflector panels, each being disposed on a respective container handle.

* * * * *